US009204683B2

(12) United States Patent
Settele

(10) Patent No.: US 9,204,683 B2
(45) Date of Patent: Dec. 8, 2015

(54) SHOE

(75) Inventor: Andreas Settele, Munich (DE)

(73) Assignee: "LOWA" SPORTSCHUHE GmbH, Jetzendorf (DE)

( * ) Notice: Subject to any disclaimer, the term of this patent is extended or adjusted under 35 U.S.C. 154(b) by 387 days.

(21) Appl. No.: 13/808,299

(22) PCT Filed: Jul. 5, 2011

(86) PCT No.: PCT/EP2011/061337

§ 371 (c)(1),
(2), (4) Date: Mar. 29, 2013

(87) PCT Pub. No.: WO2012/004271

PCT Pub. Date: Jan. 12, 2012

(65) Prior Publication Data

US 2013/0180132 A1 Jul. 18, 2013

(30) Foreign Application Priority Data

Jul. 6, 2010 (DE) ..... 10 2010 030 975

(51) Int. Cl.
*A43C 3/00* (2006.01)
*A43C 5/00* (2006.01)
(Continued)

(52) U.S. Cl.
CPC ..... *A43B 5/002* (2013.01); *A43B 23/00* (2013.01); *A43B 23/024* (2013.01);
(Continued)

(58) Field of Classification Search
CPC ..... A43B 23/00; A43C 1/04; A43C 3/00; A43C 5/00
USPC ..... 36/50.1, 51, 54; 24/712, 713.6, 713.9, 24/714, 714.8, 714.3
See application file for complete search history.

(56) References Cited

U.S. PATENT DOCUMENTS 319,190 A * 6/1885 Bryant ..... 450/141
451,694 A * 5/1891 Keith ..... 24/714.5
(Continued)

FOREIGN PATENT DOCUMENTS

JP 11-313703 A 11/1999

OTHER PUBLICATIONS

English translation of Mar. 27, 2015 Notice of Reasons for Rejection issued in Japanese Patent Application No. 2013-517365, 4 pages.
(Continued)

*Primary Examiner* — Marie Bays
(74) *Attorney, Agent, or Firm* — Rothwell, Figg, Ernst & Manbeck, P.C.

(57) ABSTRACT

The invention relates to a shoe (10) comprising a sole (13), the flexibility of which is selected such that said sole allows the foot of a user to roll with the bending of the sole (13); a shaft (12) which covers the ankle of the user and which is made of a substantially stiff upper material (26) at least in regions (14*b*, 14*c*) that laterally adjoin a tongue gap (14); and a lacing (18) which spans the tongue gap (14) and which is deflected by hook and/or eyelet elements (20), said elements being made of a rigid material. At least one tab (28) is provided on each side of the tongue gap (14) in the front foot region (12*c*) of the shoe (10) for arranging at least one hook and/or eyelet element (20), said tab being made of a material that is more flexible than the upper material (26). The tab (28) comprises a fixing portion (28*b*) that is fixed between the upper material (26) and the tongue pocket (16*a*) and a supporting portion (28*a*) on which the hook and/or eyelet element (20) is placed and rigidly connected to same.

11 Claims, 2 Drawing Sheets

Figure 1:
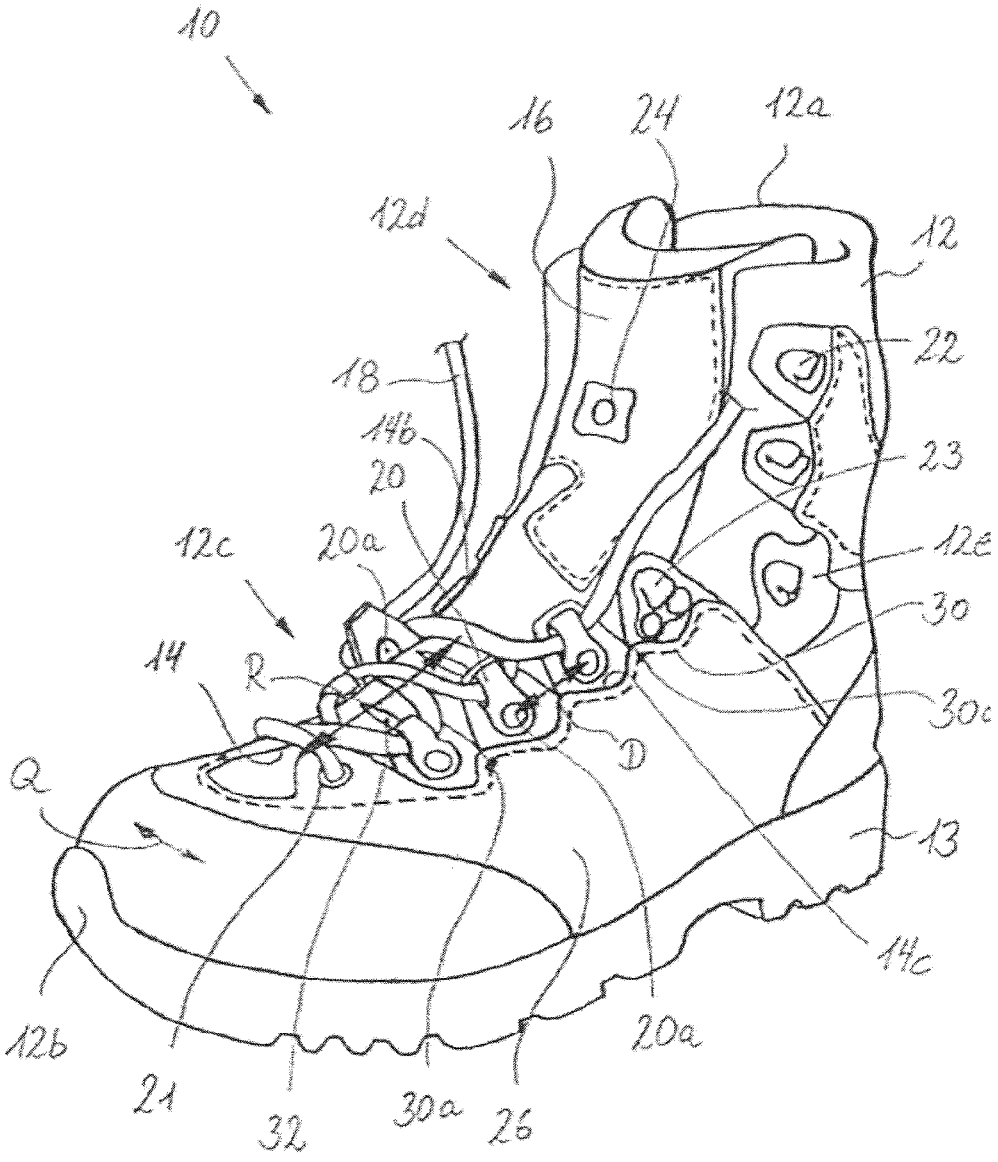

(51) Int. Cl.

| | |
|---|---|
| ***A43B 5/00*** | (2006.01) |
| ***A43B 23/00*** | (2006.01) |
| ***A43B 23/02*** | (2006.01) |
| ***A43B 23/26*** | (2006.01) |
| ***A43C 1/04*** | (2006.01) |
| ***A43C 11/20*** | (2006.01) |

(52) U.S. Cl.

CPC ..... *A43B 23/025* (2013.01); *A43B 23/26* (2013.01); *A43C 1/04* (2013.01); *A43C 3/00* (2013.01); *A43C 5/00* (2013.01); *A43C 11/20* (2013.01)

(56) References Cited

U.S. PATENT DOCUMENTS

| | | | | | |
|---|---|---|---|---|---|
| 595,833 | A | * | 12/1897 | McElroy | 24/713.6 |
| 793,095 | A | * | 6/1905 | Rapp | 36/54 |
| 1,483,702 | A | * | 2/1924 | Weingarten | 24/714.8 |
| 1,496,190 | A | | 6/1924 | Watson | |
| 1,862,047 | A | | 6/1932 | Boulet | |
| 2,108,631 | A | * | 2/1938 | Wagner | 36/45 |
| 2,253,860 | A | * | 8/1941 | Martin | 36/50.1 |
| 3,059,353 | A | * | 10/1962 | Guidici et al. | 36/50.1 |
| 3,108,385 | A | * | 10/1963 | Teufel | 36/50.1 |
| 3,484,957 | A | * | 12/1969 | Druilhet | 36/96 |
| 3,763,579 | A | * | 10/1973 | Dexter | 36/50.1 |
| 4,394,803 | A | * | 7/1983 | Goldstein | 36/51 |
| 4,534,122 | A | * | 8/1985 | MacPhail | 36/88 |
| 4,553,342 | A | * | 11/1985 | Derderian et al. | 36/97 |
| 5,167,084 | A | | 12/1992 | Flammier | |
| 5,906,057 | A | * | 5/1999 | Borsoi | 36/50.1 |
| 5,909,947 | A | * | 6/1999 | DeMarchi | 36/50.5 |
| 6,119,372 | A | | 9/2000 | Okajima | |
| 6,993,860 | B2 | | 2/2006 | Bettiol | |
| 7,650,705 | B2 | * | 1/2010 | Donnadieu et al. | 36/50.5 |
| 8,230,560 | B2 | * | 7/2012 | Luzlbauer | 24/713.4 |
| 2002/0078597 | A1 | | 6/2002 | Burt | |
| 2003/0000110 | A1 | | 1/2003 | Caeran | |
| 2003/0093918 | A1 | | 5/2003 | Challe | |
| 2005/0204585 | A1 | * | 9/2005 | Loveridge et al. | 36/54 |
| 2009/0100717 | A1 | * | 4/2009 | Cabanis | 36/116 |

OTHER PUBLICATIONS

Notice of Reasons for Rejection issued in Japanese Patent Application No. 2013-517365, 4 pages. (Mar. 27, 2015).

* cited by examiner

SHOE

CROSS REFERENCE TO RELATED APPLICATION

This application is a 35 U.S.C. 371 National Phase Entry Application from PCT/EP2011/061337, filed Jul. 5, 2011, which claims the benefit of German Patent Application No. 10 2010 030 975.3 filed on Jul. 6, 2010, the disclosure of which is incorporated herein in its entirety by reference.

The invention relates to a shoe having the following properties:

- A sole flexible enough to allow the foot to roll with the bending of the sole.
- A shaft that covers the ankle and is made, at least in the region of the toes and the lateral regions adjoining the tongue gap, of an essentially stiff upper material, for example leather that is approximately 2 mm thick.
- Lacing that spans over the tongue gap and connects the lateral regions of the upper material adjoining the tongue gap; said lacing is deflected by hook and/or eyelet elements made of a rigid material such as metal or a rigid plastic material.

With this type of shoe, there is the problem that in the region of the lower edge of the tongue gap, the upper material caves in when the foot rolls off as the sole bends during walking, and presses on the front of the foot from above. This dorsal pressure caused by the deformation of the shoe is already as such experienced as uncomfortable, but even more so as the plantar pressure acting on the sole of the foot increases mainly due to the user's weight. The increased plantar pressure leads to a quicker fatigue of the foot because of the greater forces acting on the foot. This may be expressed in a burning of the sole of the foot, the formation of blisters, and the like.

This problem is experienced primarily with so-called trekking shoes where the hook and/or eyelet elements are generally rigidly connected to the upper material of the shoe adjacent to the edges of the tongue gap, for example due to riveting to the upper material.

The problem is not experienced, or only to a lesser degree, with the so-called hiking shoes because their upper material is more flexible than that of the trekking shoes. Therefore the deformation of the upper material distributes more evenly during walking and consequently, the dorsal pressure acting on the foot is much lower.

The problem is not experienced, or only to a lesser degree, with mountain boots, in particular those designed for difficult terrain and/or for climbing, because they essentially have a rigid sole that practically does not deform during walking. Therefore, the upper material is not being deformed during walking and the dorsal pressure discussed above cannot be created to a significant extent.

With shoes where the lacing is deflected with flexible loops, for example loops made of a textile material, but also with loops that may be formed by the upper material, there is no stiffening of the upper material due to the fixing points of the hook and/or eyelet elements. For this reason alone, the resulting dorsal pressure cannot be as great as with the generic shoes. However, these shoes have the disadvantage of a greater wear and tear at the flexible loops.

Furthermore, shoes are known where eyelets are inserted into tab-like tongues of the upper material. With these shoes, the lace goes through the upper material and therefore the respective portions of the lace running under the upper material lift the upper material.

Therefore, the problem to be solved by the invention is to further develop the shoe described initially above so that despite the use of an essentially stiff upper material, and despite the use of a sole that is flexible enough to allow a rolling of the foot with bending of the sole, and despite the use of hook and/or eyelet elements made of rigid material, the dorsal pressure, which is caused by the deformation of the upper material and increases the plantar pressure, is reduced.

The object of the invention is attained with a shoe of the type described initially above where, in the front foot region of the shoe, at least one tab is provided on each side of the tongue gap to arrange at least one hook and/or eyelet element; said tab is made independently of the upper material and of a more flexible material compared to the upper material, with the tab comprising a fixing portion that is fixed between the upper material and a tongue pocket that connects the tongue and the shaft, as well as a supporting portion on which the hook and/or eyelet element is positioned and rigidly connected to the same.

In accordance with the invention, the at least one hook and/or eyelet element is exclusively rigidly connected with the supporting portion of its associated tab. In particular, it is not directly rigidly connected to the upper material, but rather only indirectly via the supporting portion and the fixing portion of the tab, which is fixed between the upper material and the tongue pocket. With that construction, the effect that stiffens the upper material in the region of the edges adjacent to the tongue gap, as is experienced with conventional trekking shoes because of the firm connection between the hook and/or eyelet elements and the essentially rigid upper material, becomes obsolete. At the same time, the advantages resulting from the use of hook and/or eyelet elements are retained. In particular, hook and/or eyelet elements are less prone to wear and tear compared to flexible loops. Furthermore, because of the fact that the hook and/or eyelet element is positioned on the fixing portion, said fixing portion is positioned flat on the surface of the shoe and does not even partially project from the same, as is the case with an eyelet that is introduced into a tab.

The connection between the fixing portion of the tab and the upper material can be formed by a seam, for example, and run over a length which, for example, corresponds to the distance between two adjacent hook and/or eyelet elements. This can also reduce the stiffening effect.

To develop the rigid connection between the at least one hook and/or eyelet element and the supporting portion of the tab in a robust fashion, in particular to be able to introduce the forces resulting from the lacing into the tab safely and with little wear and tear, it is proposed that at least one hook and/or eyelet element is riveted to its associated tab, preferably by means of a single rivet.

To be able to achieve an optimally high flexibilization with the measure in accordance with the invention, a modification of the invention proposes that at least one hook and/or eyelet element, preferably a plurality of hook and/or eyelet elements, and even more preferably all hook and/or eyelet elements, is/are arranged in single fashion on the associated tab. However, in principle, it is also conceivable to arrange a plurality of hook and/eyelet elements on a joint tab. In doing so, it is furthermore possible that said joint tab has a plurality of tongues that project beyond the upper material, for example from underneath the upper material, with one or a plurality of hook and/or eyelet elements being connected to each tongue. Finally, it is also possible that all hook and/or eyelet elements are arranged on one joint tab that encircles the tongue gap.

To obtain the greater flexibility of the tab compared to the stiffness of the upper material, said tab can be made of softer and/or thinner leather and/or microfiber material and/or textile material.

In addition or alternately to fixing the hook and/or eyelet elements on tabs made of a more flexible material compared to the upper material, the object of the invention can also be attained with a shoe of the type described above where a seam adjacent to an edge of the tongue tab, which connects the upper material and the tab and, if desired, also the tongue pocket, runs in a stepped fashion. The concave corners of this step form represent locations for the preferable deformation of the edge of the upper material, with the deformation being made easier as the bending radius of the concave corners decreases. In this way, a deformation of the upper material only in the region of the lower end of the tongue gap can be prevented. Rather, the upper material deforms over the entire length of the tongue gap. Because this also attains the object of the invention, separate patent protection is sought for this. At the same time, it goes without saying that the effect of both independently patentable measures is complementary and can also be used for one and the same shoe simultaneously.

The flexibilization effect of the step form can be increased even further in that the center direction of extension of the step form and the instep line of the foot of a shoe's user includes an angle of between about 15° and about 20°, and preferably runs essentially in the direction of the user's ankles. In the context of the present invention, "center direction of extension" is understood to be an imaginary line that runs about centrically between the convex corners and the concave corners of the steps of the stepped course of the seam. With conventional trekking shoes, where the edge of the tongue gap runs essentially in a straight line, the center direction of extension runs about parallel to the instep line of the user's foot.

At this point, it should be noted that with shoes, there is generally no "straight line" course in the strict sense of this term, but rather at best courses with a very large bending radius. In the context of the present invention, a flexibilizing effect of a portion of a given course is considered a portion where the bending radius of said portion is smaller than half of the mean distance of the hook and/or eyelet elements that are arranged in the front foot region of the shoe on both sides of the tongue gap, preferably smaller than one tenth of said mean distance, and said bend continues at least until the direction of the course has changed by at least 60°, preferably by at least 80°. An essentially straight course, on the other hand, is a course when the bending radius of the respective portion is greater than the longitudinal extension of the tongue gap in the front foot region of the shoe.

Furthermore, it should be noted that the exact course of the edges of the tongue gap depends in the respective height of the instep of the foot of the shoe's user. The statement "essentially parallel to the instep line" relates to a foot with a mean instep height, which is used as a reference foot in the context of the present invention.

Flexibilization by providing the step form can be further improved in that the distance between two adjacent concave corners of the step form is essentially equal to the distance between two adjacent hook and/or eyelet elements and/or that at least one convex corner, preferably a plurality of convex corners, of the step form is essentially arranged between two adjacent tabs.

In addition to the two independent patentable ideas, the dorsal pressure acting on the front foot can be further reduced in that the tongue has, at least in its longitudinal portion associated with the front foot, at least one region with increased flexibility. For example, the region of increased flexibility can be a region where a more flexible material is used, and/or a region where the thickness of the tongue material is reduced, in the extreme case up to forming a perforation.

It is furthermore proposed that the dimensions of the at least one region of increased flexibility is greater crosswise than in the direction of the instep line.

Figure 2:
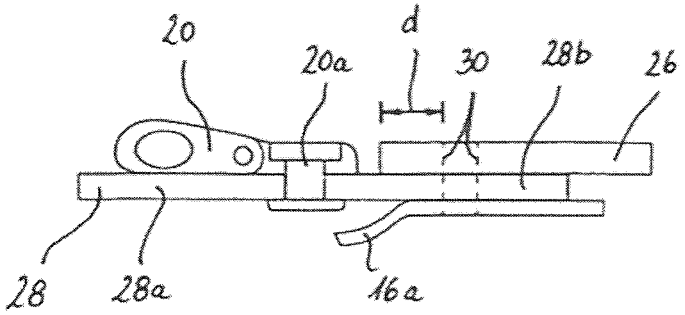
Figure 3:
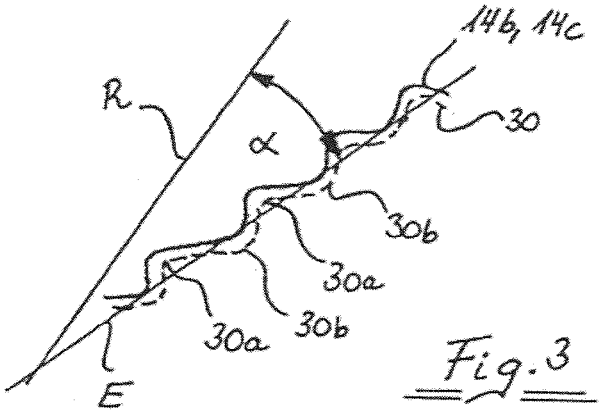

The invention is explained in the following in greater detail with an embodiment using the enclosed drawing, which shows:

FIG. 1 a perspective view of a shoe in accordance with the invention;

FIG. 2 a schematic section to explain the fixing of a tab that holds an eyelet element on the upper material of the shoe according to FIG. 1; and FIG. 3 a representation to explain the term "center direction of extension"

FIG. 1 shows a shoe in accordance with the invention with the general reference symbol 10. The shoe 10 comprises a high shaft 12, i.e., a shaft that reaches above the user's ankles and is fixed to a sole 13 that allows the rolling of the foot of the user of the shoe 10 during walking. From an upper edge 12*a* of the shaft, a tongue gap 14 extends, which runs in the direction of the shoe's tip 12*b*. The tongue gap 14 is covered on the inside of the shaft 12 by a tongue 16 that is usually connected to the shaft 12 via a tongue pocket 16*a* (see FIG. 2), for example sewed to the shaft. The shoe 10 is closed with a lace 18 that runs in a crossed fashion in the front foot instep region 12*c* of the shaft 12 through eyelet elements 20 and 21, which are fixed at the shaft 12 along the edges 14*b* and 14*c* of the tongue gap 14. Furthermore, in the lower thigh region 12*d* of the shaft 12, hook elements 22 are provided adjacent to the gap edges 14*b* and 14*c*. Finally, on the tongue 16, essentially at the level of the hook elements 22, a tongue-centering unit 24 is fixed, for example riveted to the same.

In accordance with the invention, the eyelet elements 20 are not directly connected to the upper material 26 of the shoe 10, but rather only indirectly via a tab 28. In the shown example, each eyelet element 20 is fixed on its own tab 28, i.e., the tabs 28 associated with the eyelet elements 20 are independently formed elements. Each tab 28 has a supporting portion 28*a* on which the associated eyelet element 20 is positioned and connected to the same, for example by a rivet 20*a*. The supporting portion 28*a* and a fixing portion 28*b* are connected in one piece; said fixing portion reaches under the upper material 26 of the shoe and is connected with said upper material and, if desired, also with the tongue pocket 16*a* as shown in FIG. 2, for example by means of a seam 30, preferably a double seam.

It should be added that with the shown embodiment, on both sides of the tongue gap 14 the respective uppermost hook and/or eyelet element associated with the front foot region, i.e. the hook element 23, is connected to its associated tab 28 with two rivets. This is to ensure an especially stable fixing of the hook elements 23 because in the area of transition from the front foot region into the lower thigh region of the shoe, especially high forces act on the hook and/or eye elements in the direction of the instep line of the foot in the region of the ankle joint because of the movement of the foot relative to the thigh in that region.

In accordance with the invention, not only the edges 14*b* and 14*c* of the upper material 26, which delimit the tongue gap 14 laterally, run in a stepped fashion, but the seam 30, which connects the tabs 28 in the front foot region 12*c* of the shaft 12 to the upper material 26 does as well; specifically, said seam follows in a specified distance d essentially the stepped course of the edges 14*b* and 14*c* of the upper material 26.

Because the eyelet elements 20 are not directly connected to the upper material 26, their associated rivets 20*a* cannot stiffen the upper material 26. However, a lesser stiffening effect results from the seam 30 because in the area of each eyelet element 20, said seam is connected to the upper material over a length that corresponds to the mean distance D between two adjacent eyelet elements 20. Furthermore, the thread that forms the seam 30 is made of a flexible material.

Another reduction of the stiffening effect results from the stepped course of the seam 30. Specifically, in accordance with the invention, the convex corners 30*a* of the seam 30 are preferably arranged at those locations where two adjacent tabs 28 adjoin. Therefore, the concave corners 30*b* are located approximately in the center of the extension of the tab 28 in the direction of the instep line R. In this way, the concave corners 30*b* form places of increased flexibility of the edges 14*b*, 14*c* of the upper material 26.

As shown in FIG. 1, the seam 30 runs essentially toward the ankle region 12*e* of the shaft 12. More specifically, this applies to the center direction of extension E that, according to FIG. 3, runs essentially centrically between the convex and concave corners 30*a*, 30*b* of the seam 30. Preferably, the angle α, which is included in the center direction of extension E and the instep line R, has a value of between about 15° and about 25°, preferably of about 20°.

Another measure for a flexibilization of the rolling movement of the foot of a user of the shoe 10 is to provide regions 32 with increased flexibility in the front foot portion of the tongue 16. In the shown example, these regions 32 are formed by perforations in a material that externally delimits the tongue 16, and backing these perforations with a more flexible material, for example the padding material of the tongue 16. Preferably, the dimensions of the regions 32 are greater in crosswise direction Q than in the direction of the instep line R.

The invention claimed is:

1. A shoe comprising:

a shaft that covers a user's ankle when the user is wearing the shoe with a tongue gap extending from an upper edge of the shaft toward a tip of the shoe;

a lacing that spans over the tongue gap and connects lateral regions of the shaft that adjoin the tongue gap and is deflected by hook and/or eyelet elements made of a rigid material; and at least one tab disposed on each side of the tongue gap, wherein one of said hook and/or eyelet elements is attached to each tab; and wherein said tab is made independent of the lateral regions of the shaft and is made of a material that is more flexible than a material of which the lateral regions are made, and wherein the tab comprises a fixing portion that is fixed between a portion of the lateral regions and a tongue pocket that connects a tongue and the shaft and a supporting portion to which the hook and/or eyelet element is positioned and is rigidly connected.

2. The shoe of claim 1, wherein the at least one hook and/or eyelet element is riveted to an associated tab.

3. The shoe of claim 1, wherein each hook and/or eyelet element is arranged solely on an associated tab.

4. The shoe of claim 1, wherein the lateral regions are made of leather and the tab is made of one or more materials selected from the group consisting of a softer and/or thinner leather than the leather of which the lateral regions are made, a microfiber material, and a textile material.

5. The shoe of claim 1, further comprising:

a seam adjacent to an edge of the tongue gap that connects the tab to the lateral regions, wherein at least a portion of the seam is in a stepped configuration comprising alternating concave and convex corners.

6. The shoe of claim 5, wherein the stepped configuration of the seam is oriented in a center direction of extension (E) such that an instep line (R) of the shoe includes an angle between 15° and about 25° between the instep line (R) and the center direction of extension (E).

7. The shoe of claim 5, wherein a distance between two adjacent concave corners of the seam is essentially equal to a distance between two adjacent hook and/or eyelet elements.

8. The shoe of claim 5, wherein at least one convex corner of the seam is arranged between two adjacent tabs.

9. The shoe of claim 1, wherein the tongue has a region of greater flexibility at a longitudinal portion of the tongue toward the tip of the shoe.

10. The shoe of claim 9, wherein the region of greater flexibility comprises one or more of a region of more flexible material than is used elsewhere on the tongue, a region in which a thickness of the tongue is reduced as compared to elsewhere on the tongue, and a perforation.

11. The shoe of claim 9, wherein the dimensions of the region of greater flexibility are greater in a crosswise direction (Q) than in a direction of an instep line (R).

* * * * *